US005579599A

United States Patent [19]

Haeseler

[11] Patent Number: 5,579,599

[45] Date of Patent: Dec. 3, 1996

[54] ONE-PIECE DISPLAY SIGN

[75] Inventor: David J. Haeseler, Roseland, Fla.

[73] Assignee: Neem, Inc., Sebastian, Fla.

[21] Appl. No.: 351,805

[22] Filed: Dec. 8, 1994

[51] Int. Cl.[6] ..... G09F 15/00; A45F 3/44

[52] U.S. Cl. ..... 40/606; 40/645; 40/611; 248/545; 248/156

[58] Field of Search ..... 40/606, 611, 612, 40/645, 607, 610; 248/545, 156

[56] References Cited

U.S. PATENT DOCUMENTS

| | | | |
|---|---|---|---|
| 3,880,406 | 4/1975 | Stehle et al. | 256/64 |
| 4,079,530 | 3/1978 | Atherton et al. | 40/645 |
| 4,092,792 | 6/1978 | Vorhees | 40/611 X |
| 4,253,260 | 3/1981 | Maza et al. | 40/610 |
| 4,254,569 | 3/1981 | Janik | 40/606 |
| 4,298,186 | 11/1981 | Glass | 40/606 X |
| 4,790,092 | 12/1988 | Farmer | 40/607 |
| 4,796,369 | 1/1989 | Hamann | 40/610 X |
| 4,831,760 | 5/1989 | Walker | 40/606 X |
| 4,893,455 | 1/1990 | Hughes | 40/645 X |
| 4,894,937 | 1/1990 | Davis | 40/606 |
| 4,916,840 | 4/1990 | Getz | 40/605 |
| 5,207,402 | 5/1993 | Berry-Tremmel | 248/156 |
| 5,419,134 | 5/1995 | Gibson | 40/606 |

*Primary Examiner*—Peter M. Cuomo
*Assistant Examiner*—James O. Hansen
*Attorney, Agent, or Firm*—Maguire, Voorhis & Wells, P.A.

[57] ABSTRACT

A display sign formed into a single unit having an outer first flange that defines a display section integral to a step section. A display panel bisects the outer first flange forming a flange section extending along the periphery of each side of the display panel. The step section has a U-shaped flange depending from the display section and a rectangular flange spaced inwardly the outer flange, below the display section. A rider display panel is mountable on the display section and includes an outer rectangular flange and a display panel extending therewithin. A pair of clamps are attached to the bottom of the rider display and are adapted to fit the first flange of the display section.

10 Claims, 3 Drawing Sheets

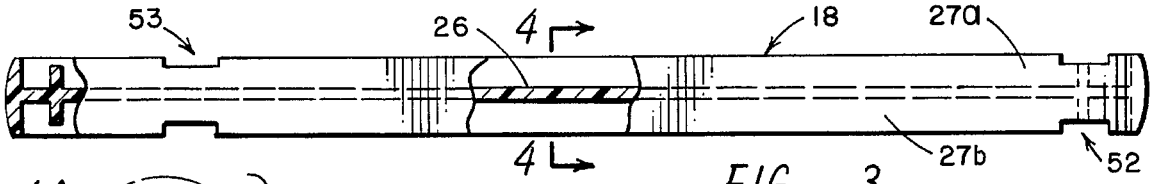
FIG. 3
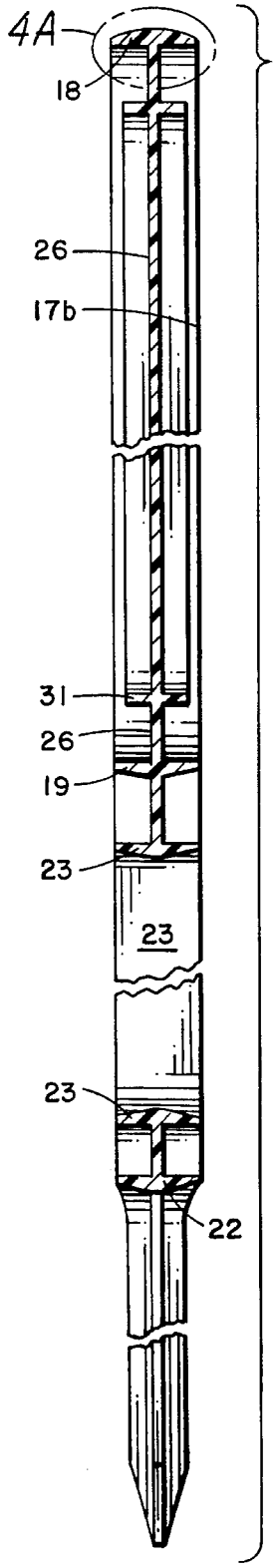
FIG. 4
FIG. 4A
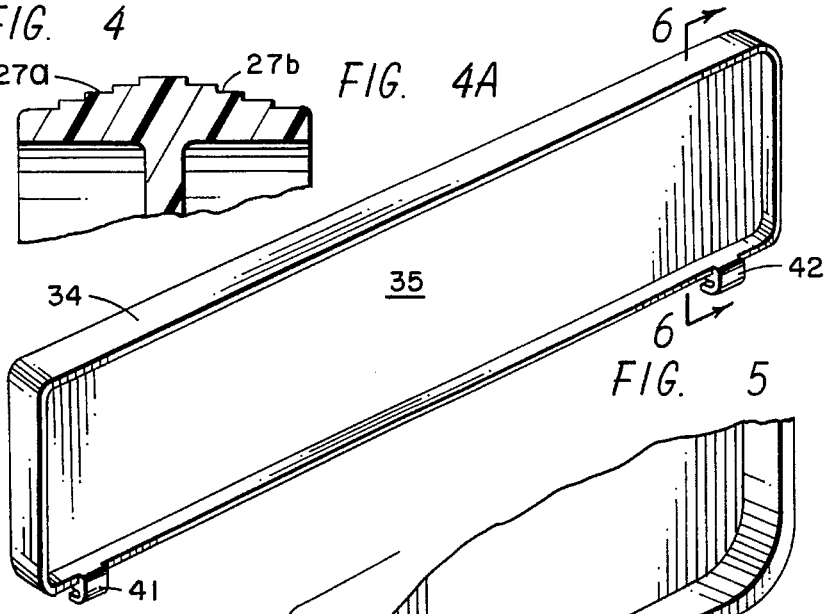
FIG. 5
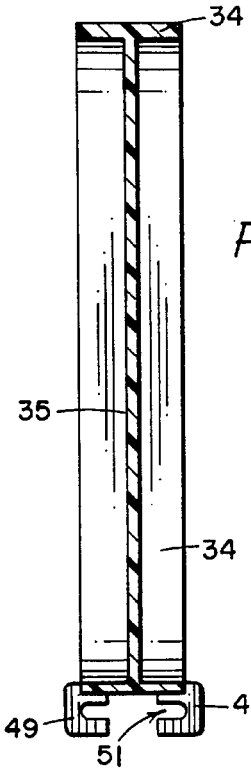
FIG. 6
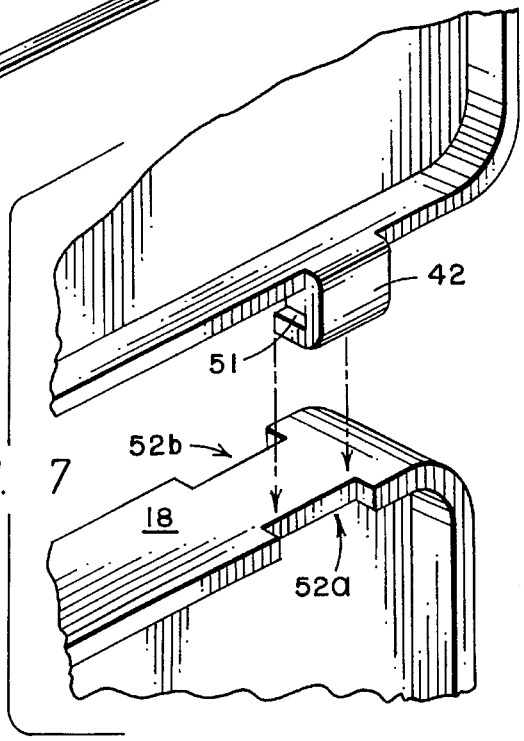
FIG. 7
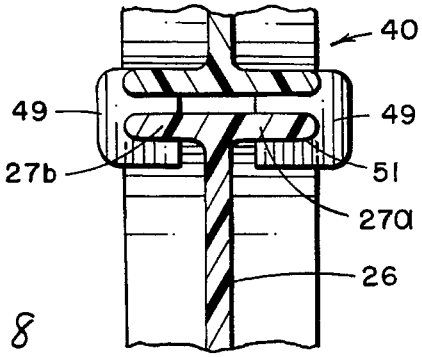
FIG. 8

ONE-PIECE DISPLAY SIGN

BACKGROUND OF THE INVENTION

This invention relates generally to display signs and more specifically to those display signs used by contractors, real estate agents and brokers in yards. Typically, these signs consist of two parallel, substantially vertical iron members with a horizontal cross member therebetween to form an upper frame, for attachment of a separate display sign. A second horizontal cross member forms a lower step and the bottom of the vertical members are ground stakes. Other signs utilize a signpost design having a vertical post with a horizontal arm. A separate display panel is attached to the horizontal arm.

Despite extensive use of the signs over the years, the problems with these signs have persisted. Since the display panel is a separate part to the sign, a user has multiple parts, which may be difficult to manipulate or install. Additionally, display frames usually require smaller hardware items to secure the sign display to the frame or sign post. When several of these signs are transported, the different parts are quite awkward to handle in and out of vehicles. Also the iron parts often rust, bleeding onto the display panel, making the display unsightly. Moreover, the rust often causes the aluminum panels to corrode. These disadvantages shorten the life of the display panels.

SUMMARY OF THE INVENTION

In view of the foregoing, it is the object of the present invention to provide a lightweight one-piece portable display sign that is easy to handle and install. It is another objective of this invention to make this sign durable and weather-resistant. Still another object is to provide a rider display frame for the sign that does not require component parts for installation and is also easy to handle and install.

These and other objectives of the invention are achieved by providing a one-piece display sign manufactured from a plastic material. The sign basically has two sections including an upper display section and a lower step section. An outer first flange defines the frame of the display section and the step section. A panel, integral to the first flange in the upper display section bisects the flange to define a display panel within the display section.

An inner flange is attached to the display panel and to the first flange of the step section. This inner flange has a horizontal bottom section that forms a step. Ground stakes are molded into the bottom of the step section. The stakes may be equipped with ridges extending along the longitudinal axis of the stakes to inhibit lateral and tilting movement of the sign.

The sign is also equipped with a rider display adapted to be detachably secured to the display frame of the sign. Similar to the display frame of the sign, the rider includes a first outer flange molded in a rectangular form with a display panel, integral therewith, bisecting the flange to form the rider display. A pair of clamps are molded toward each end of the bottom of the rider display. Each clamp consists of a pair of opposing C-shaped grippers depending from the rider display forms a channel to clasp the first flange of the display section of the sign. The outer flange has two pairs of opposing notches formed in the outer flange. In order to receive the rider display, the pair of notches are separated by the same distance between the clamps on the rider display.

BRIEF DESCRIPTION OF THE DRAWINGS

FIG. 3 is a top view of the sign illustrating the notches in the sign.

FIG. 4 is a cross-sectional view taken along line 4—4 in FIG. 3.

FIG. 5 is a perspective view of a rider attachment.

FIG. 6 is a cross-sectional view taken along line 6—6 in FIG. 5.

FIG. 7 is a perspective view of the clamp on the rider display and a corresponding notch in the sign.

FIG. 8 is a sectional view of the rider display attached to the display sign.

DETAILED DESCRIPTION OF THE DRAWINGS

Figure 1:
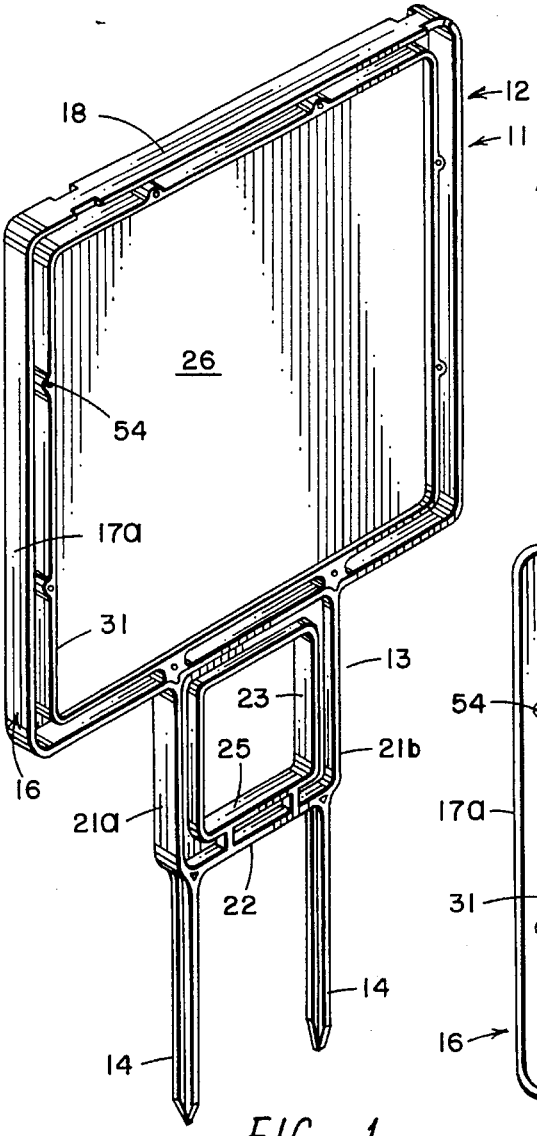
FIG. 1 is a perspective view of the sign.
Figure 11:
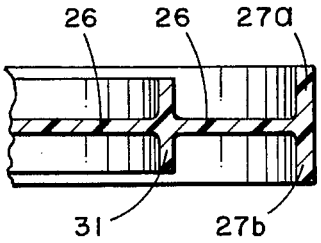
FIG. 11 is a cross-sectional view taken along line 11—11 in FIG. 2.
Figure 2:
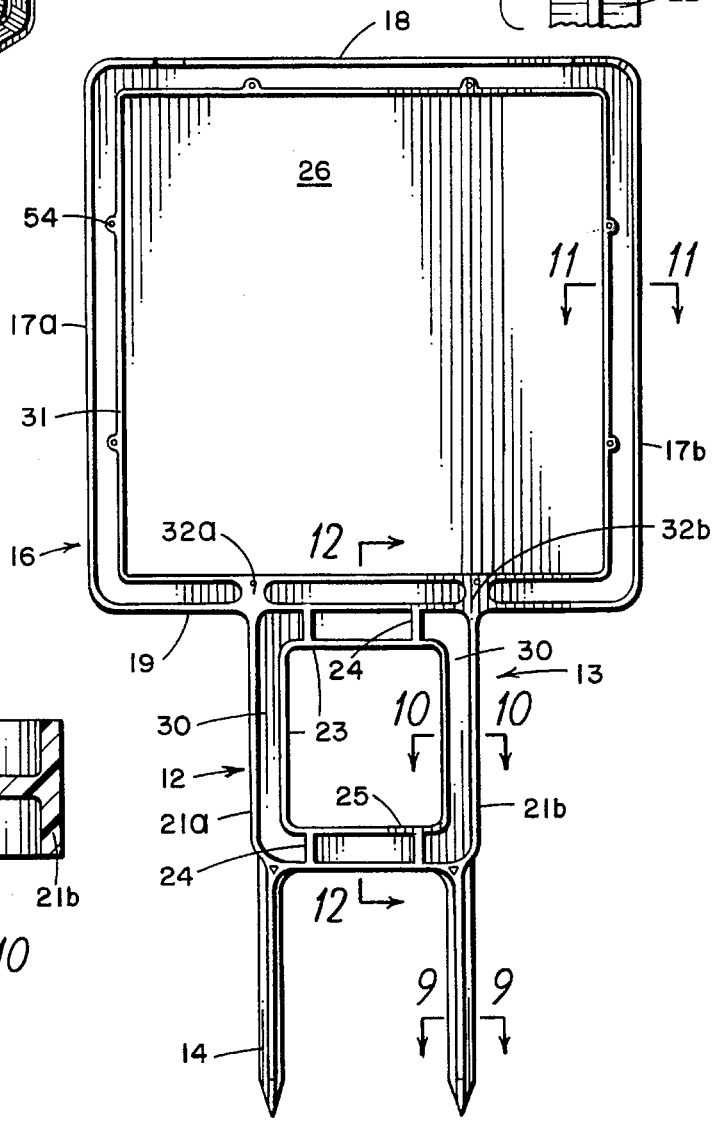
FIG. 2 is a front elevational view of the sign.
Figure 10:
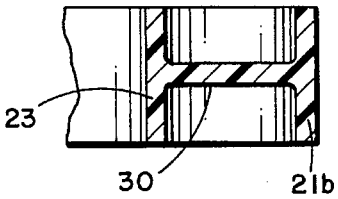
FIG. 10 is a cross-sectional view taken along line 10—10 in FIG. 2.

The one-piece sign is generally depicted in FIGS. 1 and 2 of the drawings. As shown therein, the sign generally includes an upper display section 12, lower step section 13 and the ground stakes 14. As further explained, the entire sign is preferably formed from injection molding of a plastic material as polyethylene to form a display and step section with a display panel as a single unit.

More specifically, a first outer flange 16 defines the periphery or the entire outer frame of the sign 11 display section 12 and step section 13. As shown in FIGS. 1 and 2, the flange 16 is formed to define the periphery of two rectangular sections, but one skilled in the pertinent art will realize that the flange 16 may be adapted to accommodate a variety of shapes for the sign 11.

The first outer flange 16 of sign 11 in FIGS. 1 and 2 has two parallel vertical sections **17*a* and 17*b*. A horizontal section 18 connects the top of the vertical sections 17*a* and 17*b*. A horizontal section 19 integral the bottom of each vertical section 17*a* and 17*b* extends intermediate therewith to form a frame of the upper display section of the sign 11**.

Vertical sections **21*a* and 2l*b* depend from the horizontal section 19, and a bottom horizontal section 22, integral the bottom of each section 21*a* and 21*b*, connects the bottom of the vertical sections 21*a* and 2l*b*. The horizontal section 19 also serves as the top portion of the lower step section 13. An inner rectangular flange 23 is suspended intermediate the flange sections 21*a*, 21*b* and 22 and horizontal section 19, to form the step section 13. A web 30 extends intermediate the outer flange sections 21*a*, 21*b* and 22, and horizontal section 19 along with the inner flange 23 affixing the inner flange 23** to the outer flange 16. This web 30 is actually an extension of the display panel to the step section 13 and is integral connected with the panel 26.

A bottom section 25 of the inner flange 23 defines the step used to force the sign into the ground. The step may also conveniently serve as a handle to carry the sign 11. A user simply grasps the bottom section 25 holding the Sign upside down. Additionally as shown in FIG. 4A, the flanges 27*a* and 27*b* are formed with ridges. This helps with gripping the sign for carrying and inserting it into the ground.

A display panel 26 extends intermediate the sections 17*a*, 17*b*, 18, and 19 of the outer flange 16. As illustrated in FIGS. 3 and 4, the panel 26 bisects sections 17 through 19 in a plane perpendicular to these first flange sections and extends across the entire area of the display frame 12. The panel has two sides for display on each side. Since the entire sign is ideally composed of a plastic material, a design or any desired demarcation may be printed directly onto the display panel 26. Additionally, a user may simply adhere stickers with the desired print on to the display sign.

As the display panel 26 bisects the flange 16, it forms twin flange sections 27*a* and 27*b* surrounding each side of panel 26. As will be explained in more detail below, these flanges 27*a* and 27*b* are used to mount a rider display 31 to the display section 12 of the sign 11.

Figure 9:
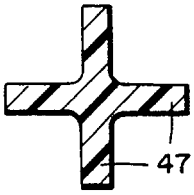
FIG. 9 is a cross-sectional view taken along line 9—9 in FIG. 2.

The sign 11 is insertable in the ground by providing ground stakes 14 molded into the step frame. As shown in FIGS. 2 and 9, vertical ridges 47 formed on each ground stake 14 inhibit lateral and tilting movement of the sign.

Figure 12:
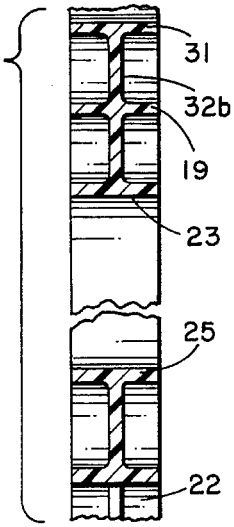
FIG. 12 is a cross-sectional view taken along line 12—12 in FIG. 2.

Ribs are placed at various locations of the sign frame enhance the overall stability of the sign 11. Vertical ribs 32*a* and 32*b* are molded to the web 30 in the step section 13 as shown in FIGS. 2 and 12. Ribs identified as 32*a* and 32*b* aid to stabilize the sign 11 at that portion where the display panel 26 meets the step section 13. An inner rectangular rib 31 is molded into the display panel 26 towards the first flange 16 having vertical and horizontal sections parallel to those sections 17–19 of the first flange 16. Ribs 32*a* and 32*b* connect the inner rib 31 to the horizontal section 19 at the junction of vertical sections 21*a* and 21*b* of the step frame and horizontal section 19.

Figure 13:
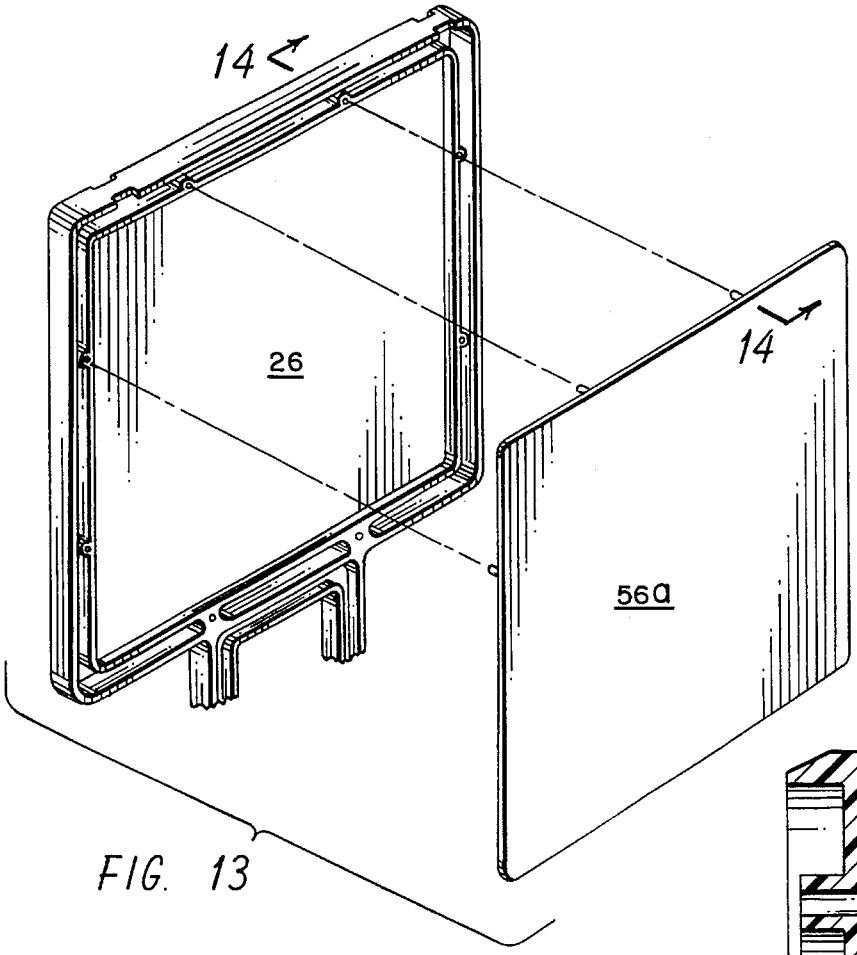
FIG. 13 is an expanded view of the one-piece display sign with a display panel mounted on the display section.
Figure 14:
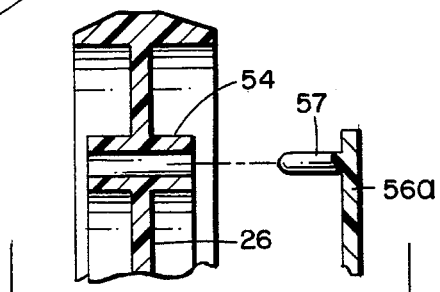
FIG. 14 a cross-sectional view taken along line 14—14 in FIG. 13
Figure 15:
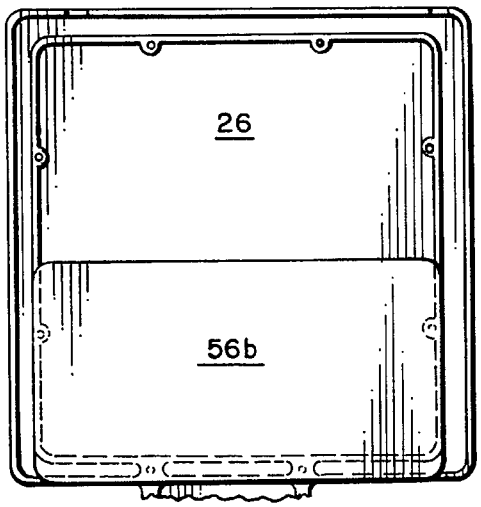
FIG. 15 is a front elevational view.
Figure 16:
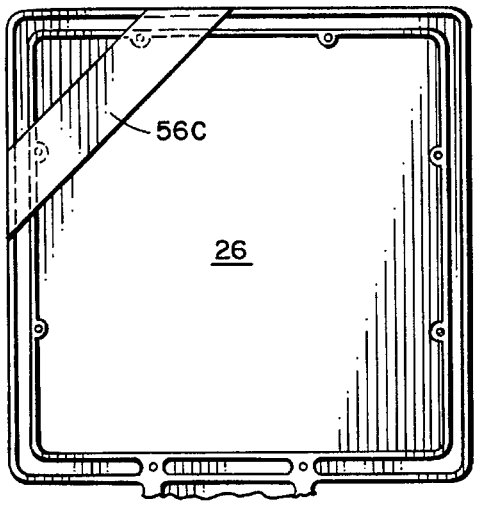
FIG. 16 is a front elevational view of the one-piece display sign with a display panel mounted in the corner of the display section.

One may also use rib 31 as a means for attachment of additional displays 56*a–c* as shown in FIGS. 13–15. Semi-cylindrical sleeves 54 are molded into the rib 31 at various locations on the rib 31. Display panels 56*a–c* are equipped with inserts 57 that fit within the sleeves 54 as shown in FIG. 14 to attach the displays to the display section. These displays 56*a–c* provide means for adding information of the display section.

This entire display sign 11 is made by injection molding of plastic. By using a plastic material as such, one is able to create a display sign with a frame and display panel that is a single unit. This one-piece display sign is light weight, easy to carry and handle. Since the display panel 26 is integral the sign frame additional hardware pieces are not required for mounting the display panel. The plastic material also renders the sign 11 virtually weather resistant. Also since iron hardware parts are not required for this assembly of the sign, rust and deterioration of parts is eliminated as a factor in the "life" of the sign.

The invention also includes a second display section, or a rider display 40, that is detachably secured to the upper display section 12. The rider display 22, similar to the first display section 12, has a first flange 34 that forms a substantially rectangular form, with each wall section bisected by the panel 35.

A clamp 41 and 42 is attached toward each end of the bottom rider display panel 31, depending therefrom as shown in FIGS. 5–7. Each clamp 41 and 42 includes a pair of opposing C-shaped grippers 49 to form a small channel 51, within which an opposing segment of each twin flange 27*a* and 27*b* fit, to mount the rider display 31 onto the outer flange 16.

In order to attach the second display 40 to the sign 11, the outer flange is equipped with at least one pair of opposing notches 52*a* and 52*b*. As shown in FIG. 1 and FIG. 7, the notches 52*a* and 52*b* are formed in the flanges 27*a* and 27*b*. The embodiment depicted in these drawings has two pair of the notches 52 and 53 formed in the outer flange 16. In this embodiment, the notches 52 and 53 are formed in top section 18 of outer flange 16.

The distance between the notches 52 and 53 matches the distance between the clamp 41 and 42. As shown in FIG. 7, when attaching the second display 31, the clamps 41 and 42 are fitted within notches 52 and 53, and the C-shaped grippers 49 are aligned with corresponding sections of the flanges 27*a* and 27*b*. A user then adjusts the rider display 31 along the longitudinal axis of the flange section 18 away from the notches 52 and 53 so the grippers clasp the outer flange 16. The rider display 31 is then removed by simply realigning the clamp 41 and 42 with the notches 52 and 53.

Similar to the sign 11, the rider display 40 additional display panels 56*a* and 56*b* are formed by injection molding of a plastic material to form single unit parts. Hardware parts as nuts and bolts are not required to mount these displays onto the display section 12, making assembly far more simple. The advantages forming the one-piece sign 11 as described earlier apply as well to the display 31, 56*a* and 56*b*.

While this specification discloses the best mode contemplated for carrying the present invention, it will be apparent that modifications or variations may be made without departing from what is regarded to be the subject matter of the invention as set forth in the appended claims.

What I claim is:

1. A one-piece display sign, comprising:

(a) a display panel;

(b) a step section integral said display panel depending therefrom having a horizontal step vertically spaced from the display panel;

(c) a first outer flange, integral the display panel, extending along a periphery of the display panel perpendicular therewith to form an upper display section and extending along a periphery of the step section to define the step section, said first outer flange defines a rectangular frame having a top and bottom horizontal section vertically spaced by two vertical flange sections, said display panel bisecting the first outer flange forming opposing flange sections perpendicular to the display panel on each side thereof extending along the periphery of the display panel said first outer flange including a U-shaped flange attached to the display section, depending therefrom and a rectangular inner flange spaced inwardly from said U-shaped flange, having a horizontal bottom step, vertically spaced from the display panel, and a web section extending intermediate the U-shaped flange with the inner rectangular flange integral each said flange;

(d) a rider display detachably secured to the sign;

(e) a clamping means for detachably securing said rider display to the flange sections on the first outer flange of the display section, wherein said clamping means for detachably securing the rider display to the first outer flange includes at least one clamp attached to the rider display and a notch formed in said first outer flange to receive said clamp on the first outer flange of the display section; and, (f) a pair of ground stakes depending from the step section for insertion into the ground.

2. A one-piece display sign as defined in claim 1 wherein said clamp includes a pair of opposing C-shaped grippers forming a channel in the clamp to receive a corresponding segment of the first outer flange on each side of the display panel.

3. A display sign comprising:

(a) a first outer flange defining the frame of the display section; and step section includes a U-shaped flange depending from said first outer flange and an inner rectangular flange spaced inwardly from the U-shaped flange and below the bottom of said first flange, said inner rectangular having a bottom horizontal section defining the step of the sign;

(b) a display panel, bisecting the first outer flange extending across the area there defined and molded to the flange to form a single unit display section, (c) a rider display adapted to be detachably secured to said: display section of the sign, and (d) rider display that includes at least one clamp to detachably secure the rider display to the fist outer flange on the display section and said flange is adapted to receive the clamp wherein said clamp includes a pair of opposing C-shaped grippers, each gripper formed to receive opposing segments of the outer flange, and a notch formed in the outer flange on each side of the display opposing one another to receive the clamp on the rider display.

4. A display sign comprising:

(a) a first flange defining,a frame of a display section and a step section of the sign; said display section includes two parallel vertical having a top and a bottom, horizontal flange section extending intermediate the top of each vertical section, and a pair of opposing horizontal sections connected to the bottom of each vertical section extending inwardly toward each other, and in the step section a vertical flange depending from an end of each horizontal bottom of the display section parallel one another, and, a second horizontal bottom intermediate the bottom of each vertical section in the step section forming (b) a display panel bisecting the flange in the display section integral the first flange;

(c) a-rectangular flange spaced inwardly of said first flange below the display panel, and integral thereto, with said rectangular flange having a substantially horizontal bottom section forming a step; and a pair of ground stakes formed in the step section for insertion of the sign into the ground.

5. A display sign as defined in claim 4 further including a rider display adapted to be detachably secured to the display section of the sign.

6. A display sign as defined in claim 5 wherein said rider display has at least one clamp connected thereto to secure the rider display to said first flange.

7. A display sign as defined in claim 4 comprising a rectangular flange spaced inwardly of said first flange below the display panel, and integral thereto, with said rectangular flange having a substantially horizontal bottom section forming a step.

8. A display sign as defined in claim 4 wherein said first flange includes two opposing flange section extending the periphery of the display panel and perpendicular to each side of the display panel.

9. A display panel as defined in claim 8 wherein said clamp is a pair of opposing C-shaped gripping members forming a channel for securing the rider display to a section of said first flange of the display section.

10. A display sign having an upper display section and a lower step section integrally attached, and a horizontal step in the step section vertically spaced below the display section, and a pair of ground stakes attached to the step section comprising:

(a) a first outer flange defining the frame of the display section;

(b) a display panel, bisecting the first outer flange extending across the area there defined and molded to the first outer flange to form a single unit display section;

(c) a rider display adapted to be detachably secured to said display section of the sign, said rider display includes a pair of clamps and each clamp is mounted on the rider display toward each end thereof and said first outer flange has two notches formed therein on at least one section of the first outer flange for receiving the rider display onto the display section; and (d) said step section further includes a U-shaped flange depending from said first outer flange and an inner rectangular flange space inwardly from the U-shaped flange and below said first outer flange, said inner rectangular flange having a bottom horizontal section defining the step of the sign.

* * * * *